United States Patent [19]

King et al.

[11] Patent Number: 4,746,833

[45] Date of Patent: May 24, 1988

[54] COUPLED CAVITY TRAVELLING WAVE TUBES

[75] Inventors: Robin C. M. King, Ongar; Richard G. Carter, Carnforth; Alan Griggs, Maldon, all of United Kingdom

[73] Assignee: English Electric Valve Company Limited, Chelmsford, England

[21] Appl. No.: 853,267

[22] Filed: Apr. 17, 1986

[30] Foreign Application Priority Data

Apr. 24, 1985 [GB] United Kingdom ..... 8510443
Jan. 30, 1986 [GB] United Kingdom ..... 8602293

[51] Int. Cl.[4] ..... H01J 25/34
[52] U.S. Cl. ..... 315/3.5; 313/39; 313/46; 315/5.35
[58] Field of Search ..... 315/3.5, 3.6, 5.35; 313/46, 39

[56] References Cited

U.S. PATENT DOCUMENTS

| | | | |
|---|---|---|---|
| 3,324,339 | 6/1967 | Winslow et al. | 315/3.5 |
| 3,885,192 | 5/1975 | Esterson et al. | 315/3.5 |
| 3,958,147 | 5/1976 | Triplett | 315/5.35 |
| 4,041,349 | 8/1977 | Davis | 315/5.35 |
| 4,057,748 | 11/1977 | Davis | 315/5.35 |
| 4,103,207 | 7/1978 | Chaffee | 315/3.5 |

*Primary Examiner*—Saxfield Chatmon
*Attorney, Agent, or Firm*—Spencer & Frank

[57] ABSTRACT

A coupled cavity TWT comprises a hollow copper tube having a plurality of tranverse walls of iron which define cavities. The walls each include an aperture on the longitudinal axis of the tube through which an electron beam passes during operation of the TWT. Any energy dissipated by electrons colliding with the surfaces of the apertures is conducted as heat away from the walls along thermal conduction paths which include copper elongate members.

21 Claims, 11 Drawing Sheets

COUPLED CAVITY TRAVELLING WAVE TUBES

BACKGROUND OF THE INVENTION

This invention relates to coupled cavity travelling wave tubes.

A travelling wave tube (TWT) is a device in which an RF (radio frequency) signal and electron beam are made to interact in such a way as to amplify the power of the RF signal. A coupled cavity TWT includes an elongate hollow tube, generally of circular or rectangular cross-section, having a plurality of walls arranged transverse to its longitudinal axis to divide its interior into a number of cavities. The centre of each wall has a passage therethrough, known as a drift tube, which is aligned with the longitudinal axis and through which the electron beam passes during operation of the TWT. The drift tubes are commonly extended in longitudinal length by tubular projections on one or both sides of their walls. Each wall also includes a slot which allows RF coupling between adjacent cavities.

Typically, the walls are designed to project beyond the part of the hollow tube which defines the lateral dimension of the cavities, giving a finned appearance. The walls in such a structure are commonly of iron, or some other ferro-magnetic material, and magnetic material is located between the projecting parts of the walls. A magnetic focusing field may thus be set up axially along the tube, tending to collimate the electron beam.

However, even when such magnetic focussing is employed, some electrons collide with the inner surfaces of the drift tubes. The energy of the electrons is dissipated into the iron causing its temperature to rise. If the temperature reaches more than about 400° C. the magnetic permeability of the iron is reduced, and the magnetic field is reduced, increasing the tendency of the electrons to collide with the surfaces of the drift tubes. Since iron is a poor conductor of heat, this effectively limits the power at which such a TWT may operate.

In one method previously employed to overcome this limitation, the walls are made of laminated iron and copper, the copper layer being intended to provide a thermal path for energy dissipated in the iron. However, this introduces some complexity in the manufacture of the structure, and hence increases its cost. A more serious objection is that optimum operation of the TWT is achieved by, amongst other things, having a certain ratio for the distance between adjacent drift tubes and the thickness of the walls. Thus, if the copper layer is simply added to the iron, the wall thickness is increased, and this results in a reduction in the impedance of the structure, which is undesirable, since it reduces the power output. To overcome this objection it is therefore necessary to reduce the iron content of the wall by an amount comparable to the amount of copper added. However, this leads to a reduction in the magnetic saturation level and may impair the magnetic focussing effect.

Another proposed method is to coat the outside of the iron walls with a thin copper layer. However, this again reduces the impedance of the structure and also introduces a capacitance between the copper layers on facing adjacent walls, reducing the impedance still further and lowering the power output.

SUMMARY OF THE INVENTION

According to the present invention there is provided a coupled cavity travelling wave tube comprising a hollow tube having at least one transverse wall which includes material of relatively low thermal conductivity and has an aperture therein through which an electron beam passes during operation of the tube, and an elongate member of material of relatively high thermal conductivity attached to the transverse wall and extensive in a path from the aperture to a heat sink to provide a thermal conduction path from the aperture to the heat sink. By employing the invention a thermal conduction path may be provided without reducing the content of the low thermal conductivity material of the transverse wall and without greatly affecting the impedance of the TWT. Where a drift tube is included it may be taken to be the aperture. Normally, said material of relatively high thermal conductivity extends from said aperture to said heat sink. Although the elongate member adds to the thickness of the transverse wall, this is localized and does not extend over its entire surface. Thus, although there is a reduction in the impedance it is only reduced by a relatively small amount. A TWT in accordance with the invention may be manufactured easily without adding greatly to the cost of manufacture of a conventional TWT.

The use of the invention is particularly advantageous where the transverse wall is of a ferro-magnetic material and is included in magnetic focussing means for focussing the electron beam. Use of the invention permits greater power levels to be reached when operating the TWT since the temperature of the iron may be maintained at an acceptably low temperature at which its magnetic permeability remains unimpaired.

Advantageously, the elongate member extends entirely across a diameter of the hollow tube. Alternatively and also advantageously, the elongate member is extensive over only a radius of the hollow tube. A cylindrical member of relatively high thermal conductivity may be attached to the transverse wall and arranged to surround the aperture, the elongate member being in thermal contact with the cylindrical member. It may be preferred that the heat sink includes at least part of the hollow tube. Also it is preferred that the hollow tube is of copper, copper having a high thermal conductivity. Preferably also the elongate member is of copper and also it is preferred that the transverse wall is of iron.

Preferably included in the travelling wave tube are a plurality of transverse walls, each including material of relatively low thermal conductivity and having an aperture therein through which the electron beam passes during operation of the tube, and a plurality of elongate members of material of relatively high thermal conductivity attached to respective transverse walls to provide thermal conduction paths from the apertures to a heat sink or sinks. If elongate members on adjacent walls face each other within a cavity, a capacitance is present between them. However, this may be reduced if desired by arranging the orientation of one of the facing members to be different to that of the other, and preferably a first member of the plurality of members attached to a transverse wall has a different orientation to that of a second member attached to another transverse wall and facing the first member. If the elongate members are extensive over only a radius of the hollow tube, a first elongate member attached to a first transverse wall may be arranged to be extensive over a first radius, and a second elongate member, attached to a second transverse wall and facing the first elongate member, arranged to be extensive over a second radius opposite to the first radius. In this arrangement the first and second elongate members have the same orientation but are not directly opposite one another, one lying on one side of the first and second transverse walls, and one lying on an opposite side.

The terms 'diameter' and 'radius' as used in this specification are intended to apply to both circular and non-circular geometries, such as for example a TWT having a rectangular cross-section.

BRIEF DESCRIPTION OF THE DRAWINGS

The invention is now further described by way of example, with reference to the accompanying drawings, in which.

Like references are used for like parts throughout.

DESCRIPTION OF THE PREFERRED EMBODIMENTS

Figure 1:
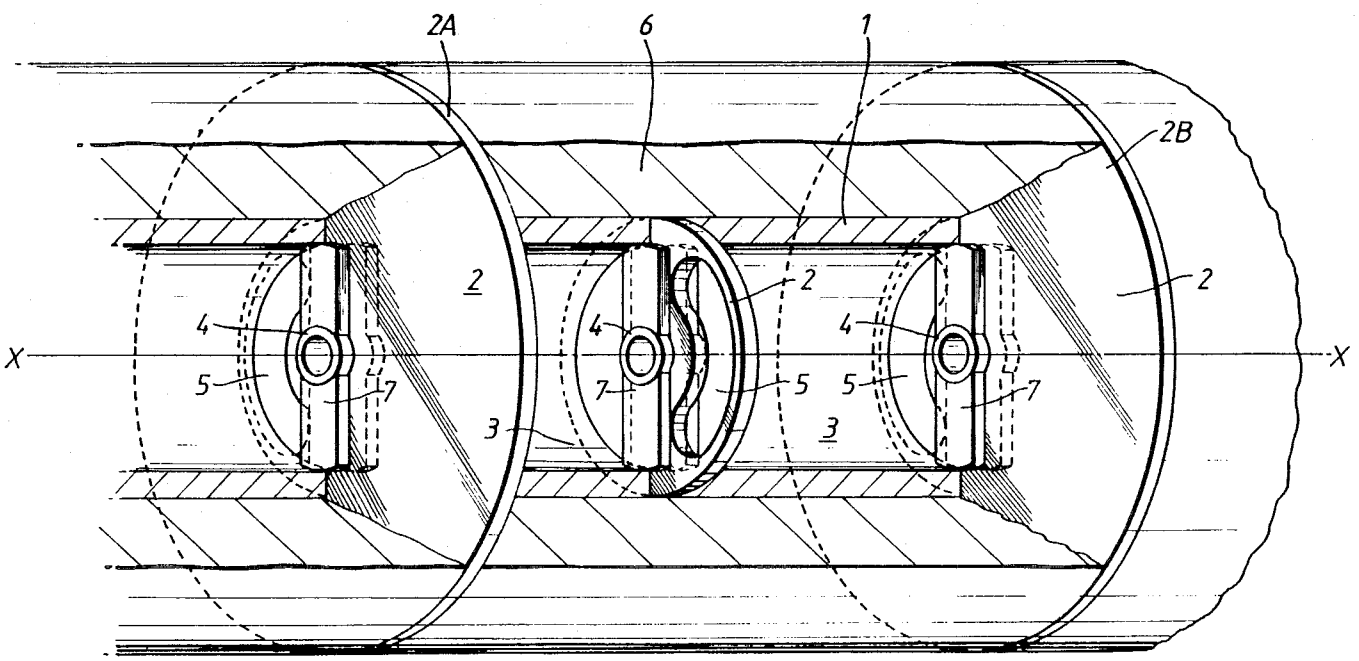
FIG. 1 illustrates part of a travelling wave tube in accordance with the invention, in perspective and partly in section.
Figure 2:
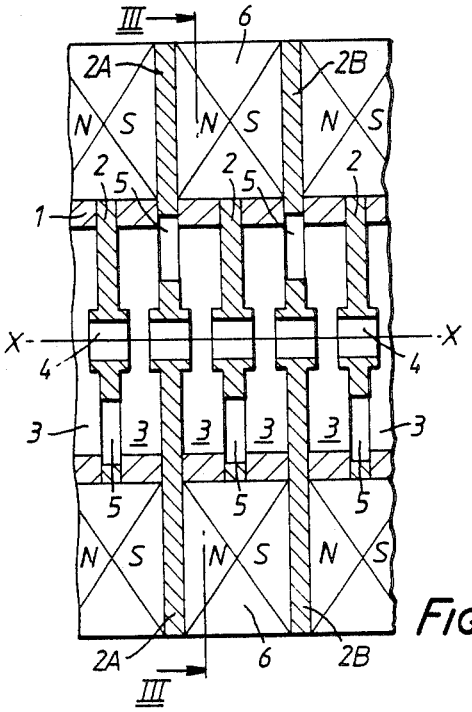
FIG. 2 is a longitudinal section of part of the travelling wave tube of FIG. 1.
Figure 3:
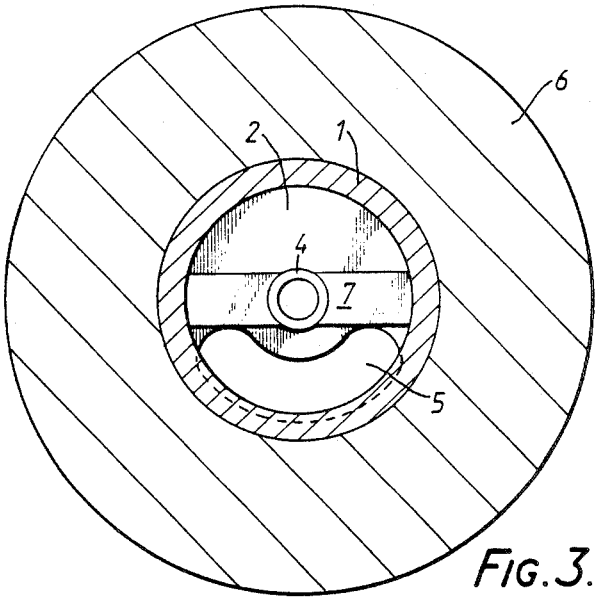
FIG. 3 is a transverse section along line III—III on FIG. 2 of the TWT of FIG. 1.

With reference to FIGS. 1, 2 and 3, a coupled cavity travelling wave tube includes a hollow copper tube 1 which is of circular cross-section. Transverse walls 2 of iron extend across the hollow tube 1 orthogonal to its longitudinal axis X—X, and, together with the hollow tube 1, define a plurality of cavities 3. Each of the transverse walls 2 has a central aperture or drift tube 4 therein, which is aligned with the axis X—X. Each transverse wall 2 also includes a coupling slot 5. Alternate ones of the transverse walls 2 have a greater diameter than the hollow tube 1 and portions 2A and 2B of these walls 2 extend beyond the lateral extent of the tube 1. Permanent magnetic material 6 is located between these portions 2A and 2B.

An elongate member 7 of substantially rectangular cross-section is attached to each face of the transverse walls 2 by brazing. Each elongate member 7 is located across a diameter of the hollow tube 1 and extends the full width of the tube 1 to make contact with its interior. The elongate members 7 each have an aperture therethrough which is aligned with the drift tube 4 in the transverse walls 2 to provide a path along the axis X—X for an electron beam.

In this embodiment of the invention the elongate copper members 7 are aligned parallel to each other, being oriented in the same direction. The coupling slot 5 through each transverse wall 2 is positioned to one side of the elongate member 7 attached to that wall 2. As shown in FIGS. 1 and 2, a coupling slot 5 is located on one side of the elongate member 7 for every other wall 2, and on the other side for the walls 2 between these. Since adjacent facing elongate members 7 are aligned there is a capacitance between them which reduces the impedance of the TWT and reduces the possible power output.

During operation of the TWT, an electron beam passes along the hollow tube 1 via the drift tube 4. An RF signal is also sent along the tube and is coupled from one cavity to an adjacent cavity by the coupling slots 5. The magnetic material 6 and the iron transverse walls 2 serve to focus the electron beam and collimate it along the axis X—X. However, there is some spreading of the electron beam caused by its interaction with the RF signal and some electrons strike the surfaces of the drift tubes 4. The thermal energy dissipated by the electrons when they collide within the surface 5 is conducted away by the elongate members 7 which provide thermal conduction paths to the wall of the hollow tube 1 which acts as a heat sink, and thus the temperature of the iron may be maintained at an acceptably low level. The copper hollow tube 1 may be cooled by liquid being passed over its outer surface.

Figure 4:
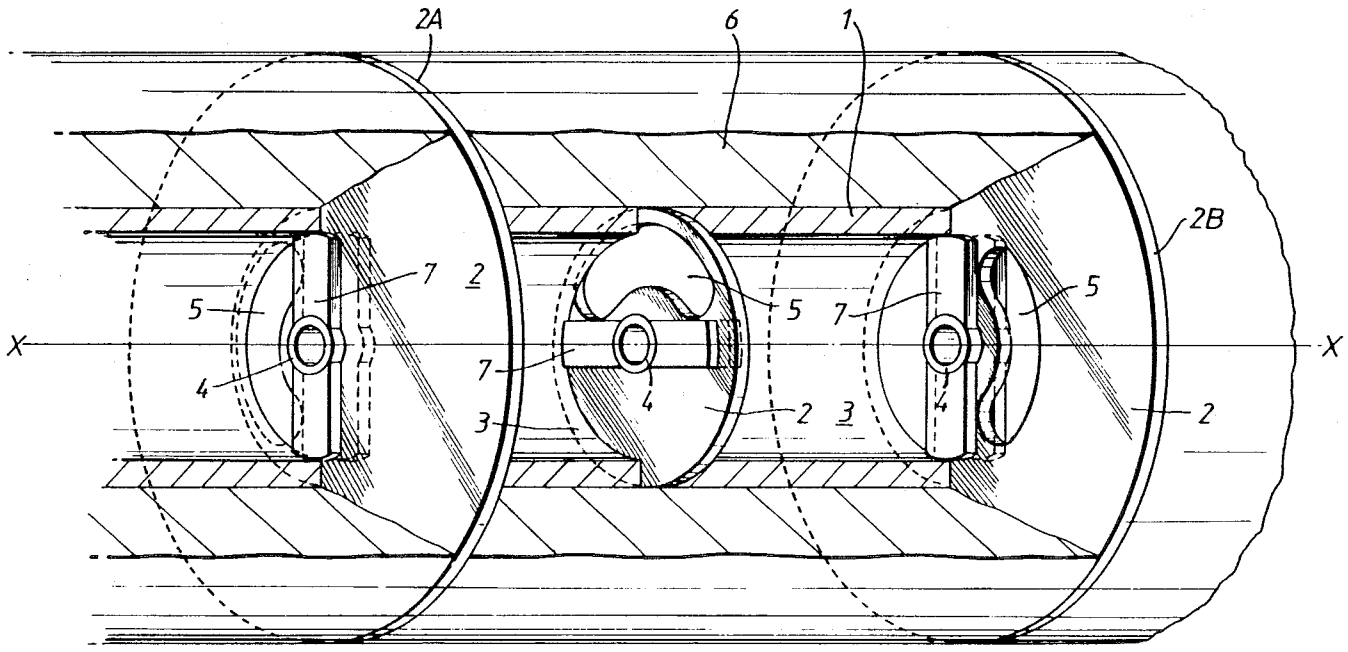
FIG. 4 illustrates part of another TWT in accordance with the invention.

With reference to FIG. 4, another coupled cavity TWT is shown which is similar to that described above except that in this case the elongate members 7 are not in line with one another but have different orientations. In this embodiment each elongate member 7 is at 90° to the elongate member 7 facing it which is attached to an adjacent wall 2. This reduces the overlap between facing elongate members 7 and hence reduces the capacitance between them. Thus the loss in impedance is less and the power output is greater than in the FIG. 1 embodiment. However, if facing elongate members are at right angles to each other there is some overlap between the coupling slots 5 in adjacent transverse walls 2, and this may somewhat impair the RF performance of the TWT.

Figure 5:
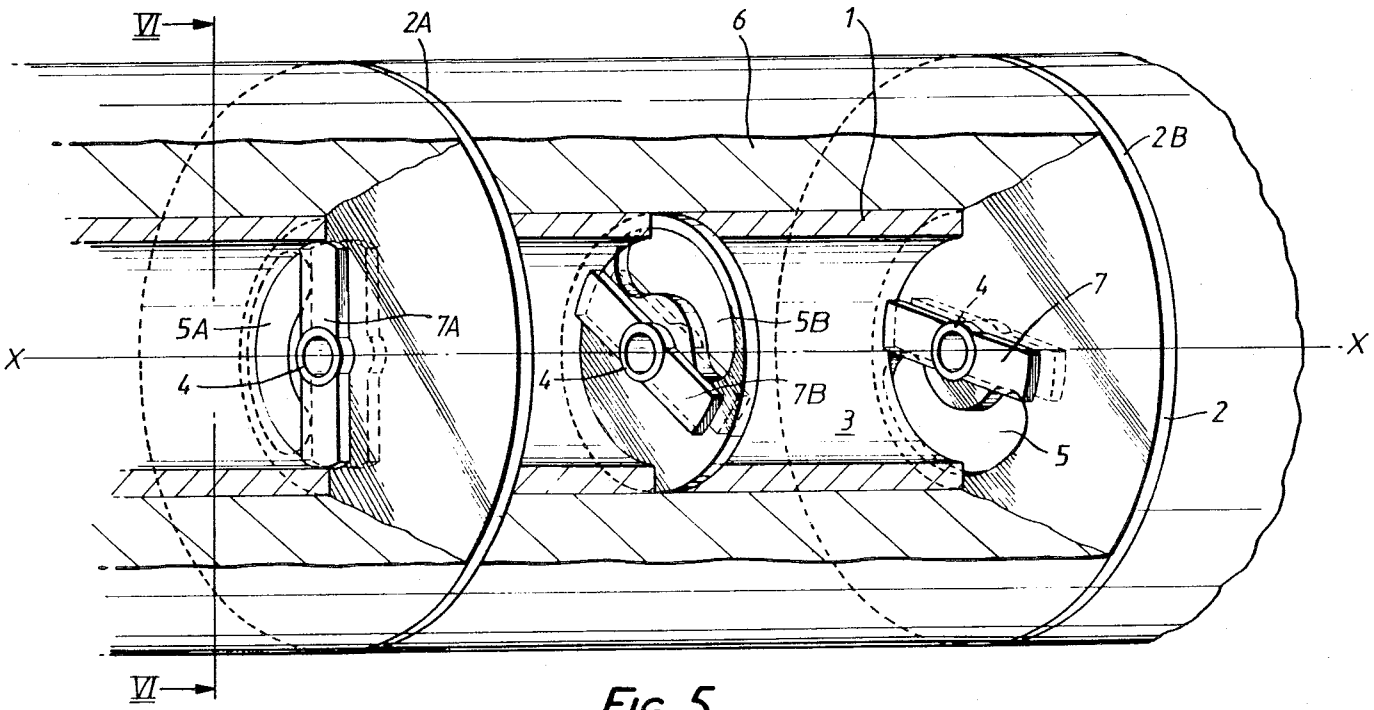
FIG. 5 illustrates part of yet another TWT in accordance with the invention.
Figure 6:
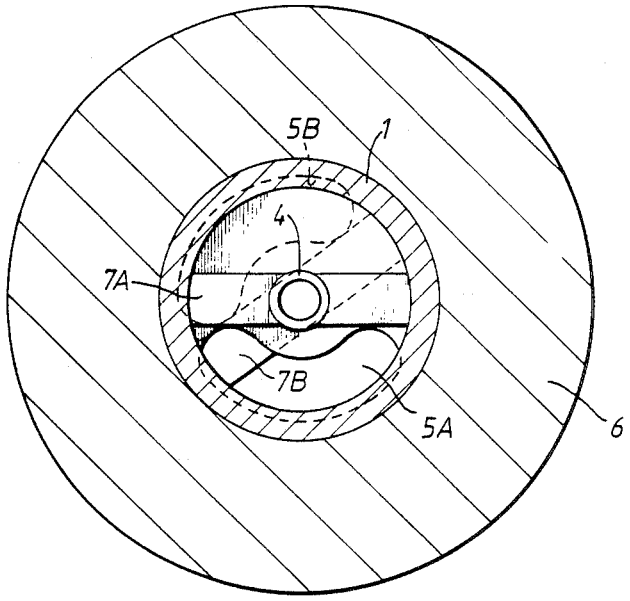
FIG. 6 is a transverse section along line VI—VI of the TWT of FIG. 5.

With reference to FIGS. 5 and 6, a further TWT has elongate members 7 arranged so that facing ones have different orientations but are not at right angles to one another. As shown, one elongate member 7A is rotated with respect to the adjacent elongate member 7B by an amount which just brings into line the edges of the coupling slots 5A and 5B in the respective transverse walls 2 but does not cause them to overlap. Thus only a small area of one elongate member 7A directly faces that of the other elongate member 7B, the capacitance between them increasing only by a small amount over that of the FIG. 4 embodiment, and there is no undesirable overlapping of the adjacent coupling slots 5.

Figure 7:
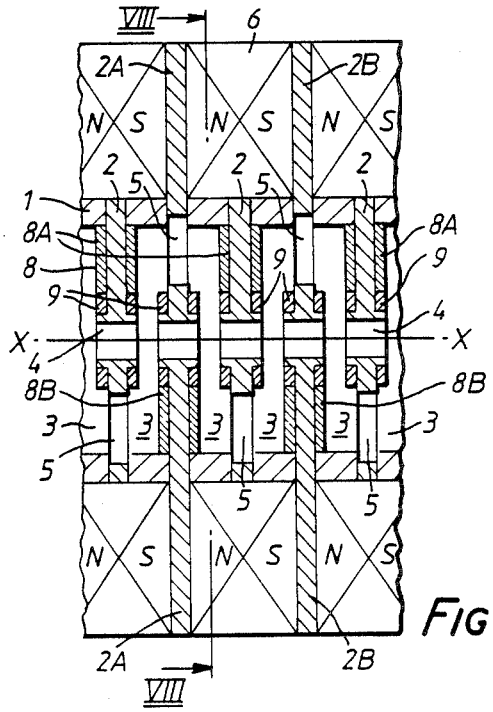
FIGS. 7, 8 and 9 are longitudinal, and transverse sections, and a perspective view respectively of a further TWT in accordance with the invention.
Figure 8:
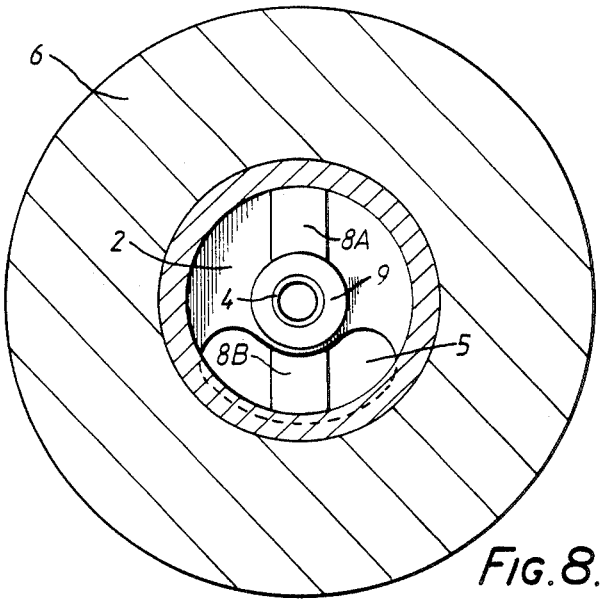
Figure 9:
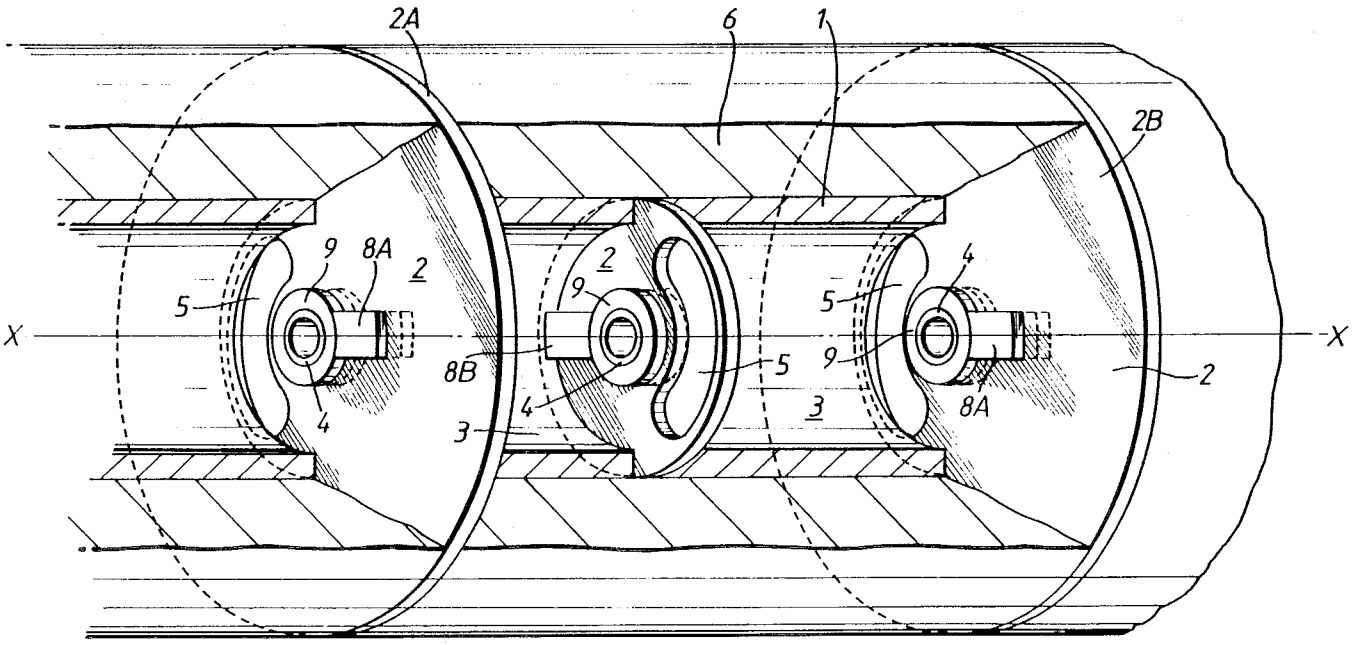

With reference to FIGS. 7, 8 and 9 another TWT in accordance with the invention, includes a plurality of copper elongate members 8 which are extensive over only a radius of the hollow tube 1 on both surfaces of the transverse walls 2. Each of the drift tubes 4 through the transverse walls 2 is surrounded by a cylindrical member 9 of copper, and each elongate member 8 extends from the inner wall of the hollow tube 1 to the cylindrical member 9 attached to the transverse wall 2 which bears that elongated member 8.

The elongate members 8 are orientated in the same direction. Ones 8A attached to alternate transverse walls 2 are arranged on a radius to one side of the longitudinal axis X—X, and the remainder 8B on the opposite radius. Thus there is only a small amount of overlap between areas of high thermal conductivity on facing surfaces of the transverse walls 2, and hence only a low capacitance between them. The copper cylindrical member 9 aids in conducting heat away from drift tube 4 region.

By using elongate members 8 which are extensive over only a radius of the tube, the coupling slots 5 in the transverse walls 2 may be arranged so that each is rotated by 180° relative to adjacent ones and there is no overlap between them. This is a particularly convenient arrangement of the coupling slots 5 since it is a conventional arrangement which gives good RF performance. In this embodiment each elongate member 8 is arranged opposite the coupling slot 5 in the transverse wall 2 to which it is attached.

Figure 10:
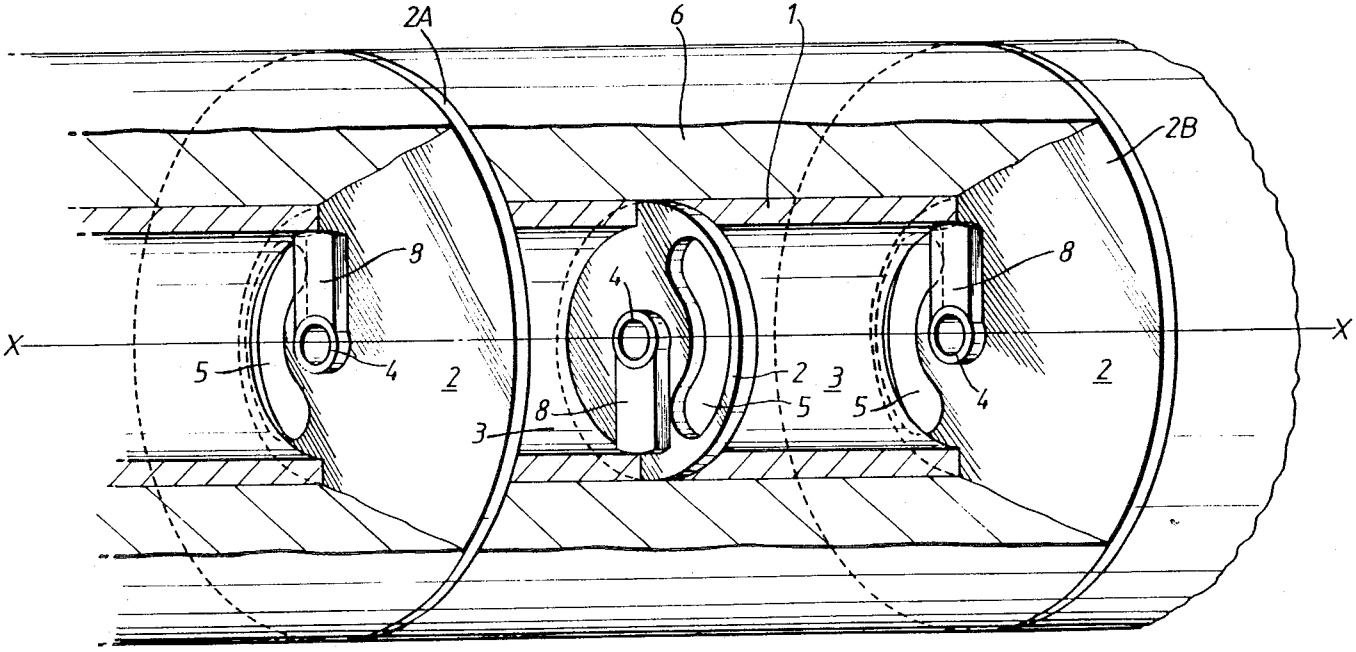
FIG. 10 is part of another TWT in perspective and partly in section.

With reference to FIG. 10, another TWT in accordance with the invention is similar to that described with reference to FIGS. 7 and 8, but no cylindrical members around the apertures 4 are included. Also in this embodiment, each elongate member 8 is arranged substantially parallel to the coupling slot 5 in the transverse wall 2 to which it is attached.

Figure 11:
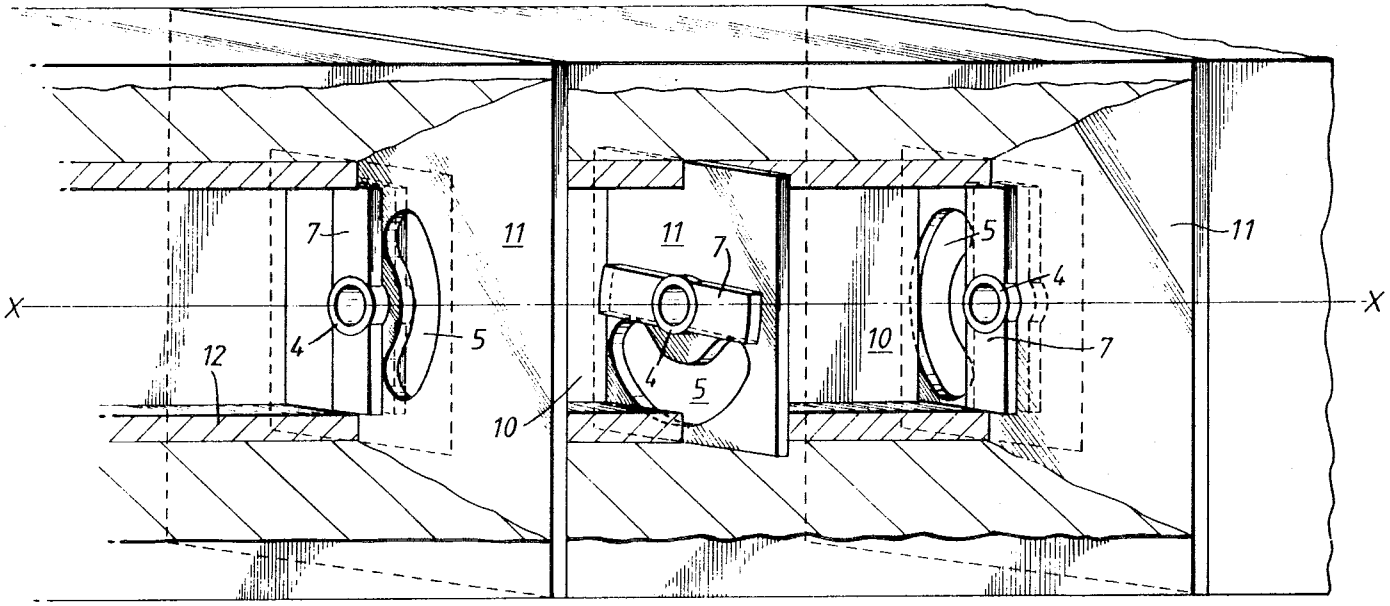
FIG. 11 is part of a further TWT in perspective and partly in section.

With reference to FIG. 11, a further TWT in accordance with the invention includes cavities 10 of square transverse section.

Elongate members of high thermal conductivity material are attached to transverse walls 11 defining the cavities 10, and each is extensive across a diameter of the hollow tube 12, which is of square transverse section.

The elongate members 7 are arranged so that each is orientated at 90° relative to adjacent ones. Each transverse wall 2 has coupling slot 5 through it.

Figure 12:
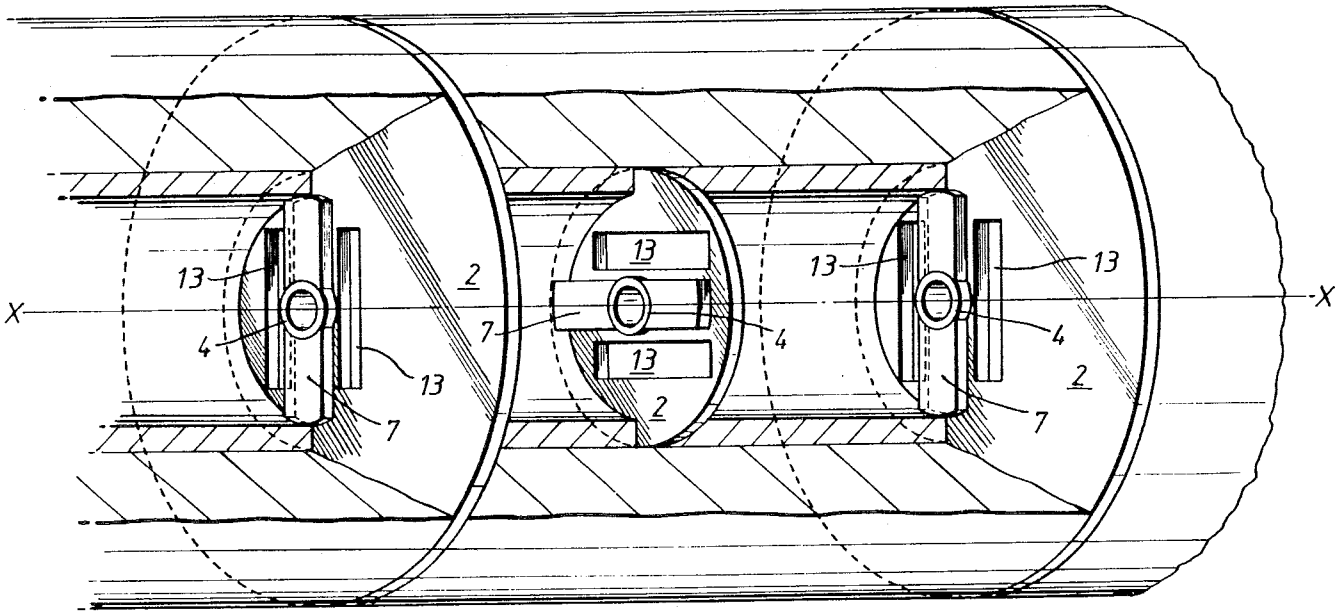
FIG. 12 illustrates another TWT.

With reference to FIG. 12, another TWT in accordance with the invention includes high thermal conductivity elongate members 7 which are arranged at 90° relative to adjacent facing ones. Each transverse wall 2 has two rectangular coupling slots 13 through it which are located on either side of the elongate members 7 attached to its surface.

Thus depending on what characteristics are desired for a TWT in accordance with the invention, the elongate members may be aligned parallel to each other with the coupling slots 5 completely separated; or the elongate member may be at 90° to adjacent elongate members but with portions of adjacent coupling slots 5 overlapping; or the elongate members may only partially face adjacent elongate members with no overlapping of adjacent coupling slots 5; or the elongate members may only partially face adjacent ones, with some partial overlapping of adjacent coupling slots 5. Also the elongate members need not be extensive over an entire diameter but may be of any convenient length of position. Of course TWT might include more than one of these possible arrangements.

Figure 13:
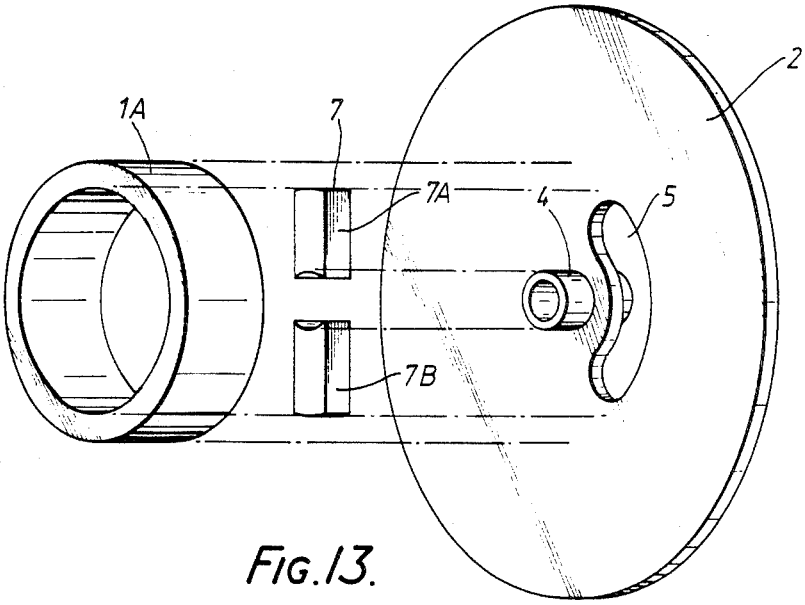
FIGS. 13 and 14 are exploded perspective views illustrating the construction of the TWT of FIG. 1.
Figure 14:
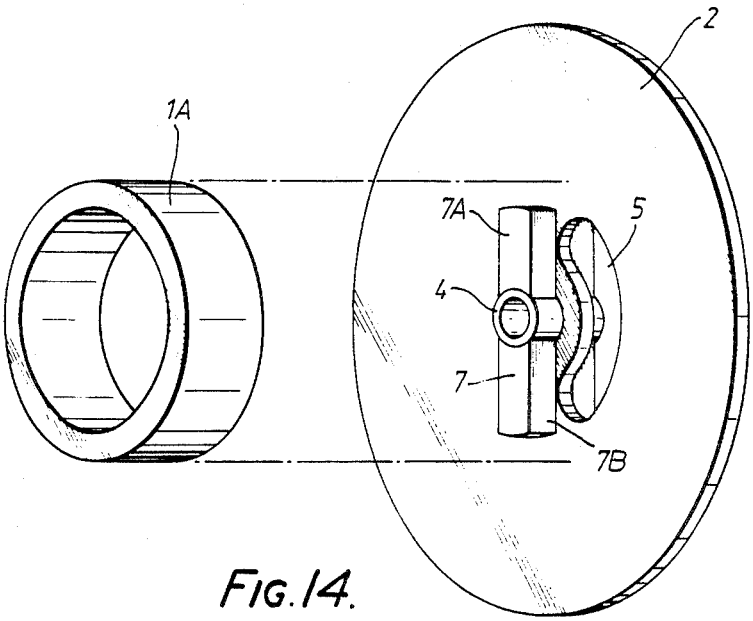

With reference to FIGS. 13 and 14, part of the TWT of FIG. 1 is assembled by firstly brazing copper members 7A and 7B onto a transverse wall 2 to form an elongate member 7. Then a copper ring 1A forming part of the hollow tube 1 is added. A number of such parts of the TWT are joined together to form the complete structure. Where a cylindrical member is arranged to surround an aperture, it may be initially discrete from the elongate member and fitted separately.

What we claim is:

1. A coupled cavity travelling wave tube comprising: a hollow tube having at least one transverse wall, said transverse wall including material of relatively low thermal conductivity and having an aperture therein through which an electron beam is arranged to pass during operation of the travelling wave tube; and an elongate member of relatively high thermal conductivity material attached to said transverse wall and extensive in a path from said aperture to a heat sink to provide a thermal conduction path from said aperture to said heat sink.

2. A travelling wave tube as claimed in claim 1 and wherein said transverse wall is of a ferro-magnetic material and is included in magnetic focussing means arranged to focus said electron beam.

3. A travelling wave tube as claimed in claim 1 and wherein said elongate member extends entirely across a diameter of said hollow tube.

4. A travelling wave tube as claimed in claim 1 and wherein said elongate member is extensive over a radius only of said hollow tube.

5. A travelling wave tube as claimed in claim 1, and including a cylindrical member of relatively high thermal conductivity material attached to said transverse wall and arranged to surround said aperture, said elongate member being arranged in thermal contact with said cylinder.

6. A travelling wave tube as claimed in claim 1 and wherein said transverse wall includes a coupling slot.

7. A travelling wave tube as claimed in claim 6 and wherein said transverse wall includes two coupling slots arranged one to each side of said elongate member.

8. A travelling wave tube as claimed in claim 1 and including: a plurality of transverse walls, each including material of relatively low thermal conductivity and having an aperture therein through which the electron beam is arranged to pass during operation of the travelling wave tube; and a plurality of elongate members of relatively high thermal conductivity material attached to respective ones of said transverse walls to provide thermal conduction paths from said apertures to the or a heat sink.

9. A travelling wave tube as claimed in claim 8 and wherein a first member of said plurality of elongate members, attached to a first transverse wall, has a different orientation to that of a second elongate member attached to another transverse wall and is arranged to face said first member.

10. A travelling wave tube as claimed in claim 9 and wherein said first member is arranged to lie at 90° with respect to said second member.

11. A travelling wave tube as claimed in claim 8 and wherein a first elongate member is attached to a first transverse wall and is arranged, extensive over a first radius of said hollow tube; and a second elongate member is attached to a second transverse wall and faces the first elongate member, and is arranged extensive over a second radius of said hollow tube opposite side first radius.

12. A travelling wave tube as claimed in claim 8, and wherein each transverse wall includes a respective coupling slot, the coupling slots being arranged such that a first slot in one transverse wall does not overlap, in a direction normal to the planes of the transverse walls, with a second slot in an adjacent transverse wall.

13. A travelling wave tube as claimed in claim 1 and wherein said heat sink includes at least part of said hollow tube.

14. A travelling wave tube as claimed in claim 1 and wherein said hollow tube is of copper.

15. A travelling wave tube as claimed in claim 1 and wherein said transverse wall is of iron.

16. A travelling wave tube as claimed in claim 1 and wherein said elongate member is of copper.

17. A coupled cavity traveling wave tube, comprising:

a hollow tube having a tube wall and a longitudinal axis;

a transverse wall member mounted in the tube, the wall member having a flat surface which is disposed perpendicular to the longitudinal axis of the tube and having an aperture which is disposed along the longitudinal axis to permit passage of an electron beam, the wall member additionally having a flange around the aperture, the wall member additionally having a coupling slot which is spaced apart from the flange, and elongated member of relatively high thermal conductivity affixed to the wall member, the elongated member having a longitudinal axis which is perpendicular to the longitudinal axis of the tube, the elongated member extending from the flange and contacting the tube wall to transfer heat to the tube wall.

18. A traveling wave tube as claimed in claim 17, wherein the flange has an outer end which is spaced apart from the flat surface of the wall member by a predetermined flange height, and wherein the elongated member has a thickness which is approximately the same as the flange height.

19. A traveling wave tube to be as claimed in claim 18, wherein the flange is cylindrical, and wherein the elongated member has a width which is approximately the same as the outer diameter of the flange.

20. A traveling wave tube as claimed in claim 17, further comprising another elongated member of relatively high thermal conductivity affixed to the wall member and extending from the flange to the tube wall to transfer heat to the tube wall, the another elongated member having a longitudinal axis which coincides with the longitudinal axis of the elongated member.

21. A traveling wave tube as claimed in claim 17, further comprising:

an additional transverse wall member mounted in the tube at a position spaced apart from the wall member, the additional wall member having a flat surface which faces the flat surface of the wall member and which is parallel to the flat surface of the wall member, the additional wall member having an aperture which is disposed along the longitudinal axis of the tube to permit passage of the electron beam, the additional wall member having a flange around the aperture therein, the additional wall member having a coupling slot which is spaced apart from the flange; and an additional elongated member of relatively high thermal conductivity affixed to the additional wall member, the additional elongated member having a longitudinal axis which is perpendicular to the longitudinal axis of the tube but which is not parallel to the longitudinal axis of the elongated member, the additional elongated member extending from the flange of the additional wall member and contacting the tube wall to transfer heat to the tube wall.

* * * * *